US012241260B2

(12) United States Patent
White

(10) Patent No.: US 12,241,260 B2
(45) Date of Patent: Mar. 4, 2025

(54) DECKING CLIP AND DECKING ASSEMBLY COMPRISING A DECKING CLIP

(71) Applicant: RYNO LTD., Cranleigh (GB)

(72) Inventor: Anton Bruce White, Ellon (GB)

(73) Assignee: RYNO LTD., Cranleigh (GB)

( * ) Notice: Subject to any disclaimer, the term of this patent is extended or adjusted under 35 U.S.C. 154(b) by 189 days.

(21) Appl. No.: 18/013,607

(22) PCT Filed: Jun. 29, 2021

(86) PCT No.: PCT/EP2021/067921
§ 371 (c)(1),
(2) Date: Dec. 29, 2022

(87) PCT Pub. No.: WO2022/002980
PCT Pub. Date: Jan. 6, 2022

(65) Prior Publication Data

US 2023/0250647 A1 Aug. 10, 2023

(30) Foreign Application Priority Data

Jun. 29, 2020 (GB) ..... 2009927

(51) Int. Cl.
*E04F 15/02* (2006.01)
*E04F 15/06* (2006.01)

(52) U.S. Cl.
CPC .. *E04F 15/02183* (2013.01); *E04F 15/02044* (2013.01); *E04F 15/06* (2013.01); *E04F 2015/02122* (2013.01)

(58) Field of Classification Search
CPC ..... E04F 15/02186; E04F 15/02044; E04F 15/06; E04F 2015/02122;
(Continued)

(56) References Cited

U.S. PATENT DOCUMENTS 5,950,377 A * 9/1999 Yoder ..... E04F 15/10 52/177
6,233,886 B1 * 5/2001 Andres ..... E04F 15/10 52/489.1
(Continued)

FOREIGN PATENT DOCUMENTS

CA 2622078 A1 8/2008
DE 202009003138 U1 * 9/2010 ..... E04F 15/02044
(Continued)

OTHER PUBLICATIONS

IPO, Search Report for GB2009927.1, Dec. 4, 2020.
(Continued)

*Primary Examiner* — Theodore V Adamos
(74) *Attorney, Agent, or Firm* — Hodgson Russ LLP

(57) ABSTRACT

A decking assembly comprising a first decking panel (202), a second decking panel (202') adjacent the first decking panel (202), a clip (100) comprising a base (102) and a retaining portion (104), wherein the retaining portion (104) cooperates with the first decking panel to affix the clip thereto, the base projects from the first decking panel to engage the second decking panel and, the base defines a fastener opening for receiving a fastener to secure the first and second decking panels to an underlying substrate.

16 Claims, 2 Drawing Sheets

(58) Field of Classification Search
CPC ..... E04F 2015/02116; E04F 15/02183; E04F 2015/02094; E04F 15/02038; E04F 2201/0517; E04F 2201/05; E04F 13/0889; E04F 13/0891; E04F 13/0892; E04F 13/0894; E04F 13/26; E04F 13/081; E04F 13/0812; E04F 13/0814; E04F 13/0816; E04F 13/0819; E04F 13/0821; E04F 13/0825; E04F 13/0826
See application file for complete search history.

(56) References Cited

U.S. PATENT DOCUMENTS

| | | | | |
|---|---|---|---|---|
| 2003/0101673 | A1 | 6/2003 | West et al. | |
| 2005/0039413 | A1 | 2/2005 | Schrontenboer | |
| 2005/0284072 | A1* | 12/2005 | Andres | E04F 15/10 52/578 |
| 2012/0110944 | A1* | 5/2012 | Hess | E04F 15/02044 29/525.08 |
| 2016/0060880 | A1* | 3/2016 | Stover | E04F 15/02044 52/582.2 |
| 2019/0211856 | A1* | 7/2019 | Getsiv | F16B 7/0473 |
| 2019/0309527 | A1* | 10/2019 | Bergelin | E04F 15/02044 |
| 2019/0360214 | A1* | 11/2019 | Vandenberg | F16B 5/002 |
| 2020/0087925 | A1* | 3/2020 | Vandenberg | E04F 15/183 |
| 2020/0217084 | A1* | 7/2020 | Ylikangas | E04F 15/02005 |

FOREIGN PATENT DOCUMENTS

| | | | | |
|---|---|---|---|---|
| DE | 202013102695 | U1 * | 8/2013 | E04F 15/02044 |
| DE | 102013113233 | A1 | 2/2015 | |
| EP | 1965003 | A2 | 9/2008 | |
| EP | 3112554 | A1 * | 1/2017 | E04F 15/02044 |
| EP | 3453814 | A1 | 3/2019 | |
| GB | 2592402 | A * | 9/2021 | E04F 15/02183 |
| JP | 2004137675 | A | 5/2004 | |
| JP | 2005344371 | A | 12/2005 | |
| JP | 2010065404 | A * | 3/2010 | E04F 15/02 |
| WO | 2005024154 | A1 | 3/2005 | |
| WO | WO-2007051214 | A1 * | 5/2007 | E04F 15/04 |
| WO | 2018158149 | | 9/2018 | |
| WO | 2019240656 | A1 | 12/2019 | |
| WO | WO-2023052483 | A1 * | 4/2023 | E04F 15/02038 |

OTHER PUBLICATIONS

WIPO, Search Report for PCT/EP2021/067921, Nov. 3, 2021.
EPO, Examination Report for EP Application No. 21743378.8, Sep. 2, 2024.

* cited by examiner

DECKING CLIP AND DECKING ASSEMBLY COMPRISING A DECKING CLIP

TECHNICAL FIELD

This invention relates to a decking clip and a decking assembly comprising such a clip. More specifically, the present invention related to a clip for the spacing and retention of extruded metal decking panels.

BACKGROUND OF THE INVENTION

Exterior ground surfaces, such as decking or paving, are popular in a variety of different settings. In general, a plurality of support joists, which may or may not be arranged in a lattice, are secured to pedestals, cradles, i-beams or other structures which directly contact the ground surface.

Decking and other exterior flooring systems for balconies and terraces are sometimes prefabricated for many reasons, e.g. cost, efficiency and speed of installation. Metal is a hard material that has a tendency to rattle when two components (such as decking panels) are positioned adjacent to each other. When implementing a metal decking system, it is desirable to try and eliminate any rattling in use.

Further, it is also desirable to prevent any loosening of fasteners.

Also, it is desirable to provide a system where individual decking panels can be removed and replaced in case of e.g. damage. Also, it is advantageous to have some boards that are easily removeable to allow access to lifting points to allow access to e.g. lifting points for decked balconies that need to be lifted into place.

The present application aims to address some of the above-mentioned issues.

SUMMARY OF THE INVENTION

According to a first aspect of the invention there is provided a decking assembly comprising:

- a first decking panel;
- a second decking panel adjacent the first decking panel;
- a decking clip comprising a base and a retaining portion, wherein:
  - the retaining portion is configured to engage the first decking panel such that the decking clip in retained in engagement with the first decking panel; and,
  - wherein the decking clip defines a fastener opening for receiving a fastener to secure the first and second decking panels to an underlying substrate.

Advantageously, the provision of a retaining portion on the clip allows the clip to be affixed to the first decking panel and remain in situ as it is moved into position. Preferably the clip has a mating engagement with the decking panel and is a 'tight fit'. It can then be used to clamp the first and second panels to an underlying substrate via the fastener opening.

Preferably the decking clip is at least partially coated in a coating material, wherein the coating material is disposed on at least one surface in contact with the first decking panel.

Preferably the coating material is less stiff than the material from which the clip is constructed. Preferably it is elastically deformable so as to provide a resilient restoring force upon compression when the clip is in situ. In this way, the clip is retained.

Preferably the retaining portion is resiliently deformable and is configured to engage the first decking panel such that resilient deformation of the retaining portion provides a retaining force to retain the decking clip in engagement with the first decking panel.

Preferably the decking clip comprises a base, wherein the base projects from the first decking panel to engage the second decking panel in use.

Preferably the retaining portion is an upright extending from the base and comprises a curved portion.

Preferably the upright comprises an S-shaped portion proximate the base to facilitate elastic deformation when the clip is deformed by tightening of the fastener.

Preferably the retaining portion has a lower thickness than the base such that has a lower stiffness relative to the base.

Preferably the base extends at an angle from the first decking panel such that a clearance gap is provided between the clip and the second decking panel, which gap is closed upon fastening of the fastener.

Preferably an angle of less than 90 degrees is defined between the upright and the base.

Preferably the first decking panel comprises a support flange and a pocket above the support flange, and wherein the retaining portion is an upright engaging the pocket when the base contacts the flange.

Preferably the contact between the upright and the pocket and the contact between the flange and the base is such that a torque is applied to the clip to retain the clip relative to the first decking panel.

Preferably the base defines a first foot contacting the first decking panel and a second foot contacting the second decking panel.

Preferably the retaining portion comprises a U-shaped portion proximate a free end.

Preferably the uppermost tip of the upright is curved.

Preferably the uppermost tip of the upright engages the first panel.

According to a second aspect there is provided a decking clip comprising:

- a base defining an opening for a fastener; and,
- a retaining portion extending from the base,
  - wherein the retaining portion comprises an elastically deformable coating configured to elastically deform upon assembly with a decking panel to retain the clip.

Preferably the retaining portion is curved and has a lower thickness than the base such that the retaining portion has a lower stiffness than the base.

Preferably the upright comprises an S-shaped portion proximate the base to facilitate relative elastic deformation.

Preferably the retaining portion and base are at an angle of 90-θ degrees to each other such that when the retaining portion is engaged with a decking member, the base projects therefrom at an angle of θ degrees to the horizontal, where $\theta>0$.

Preferably the base defines a first foot for contacting a first decking panel and a second foot for contacting a second decking panel.

Preferably the upright comprises a U-shaped portion proximate a free end.

Preferably the uppermost tip of the upright is curved.

According to a third aspect there is provided a method of installing a decking assembly comprising the steps of:

- providing a first decking panel;
- providing a second decking panel;
- providing a decking clip;
- affixing the clip to the first decking panel by engaging the clip into the first decking panel to retain the decking clip;

positioning a second decking panel adjacent the first decking panel;

securing a fastener through the opening and thereby elastically deforming the decking clip to clamp the first and second decking panels to an underlying substrate.

Preferably the decking clip is configured to be a tight fit in the decking panel to retain the decking clip.

Preferably the decking clip comprises a coating of a resilient material, which material is compressed upon engagement with the first decking panel.

DETAILED DESCRIPTION

Figure 1:
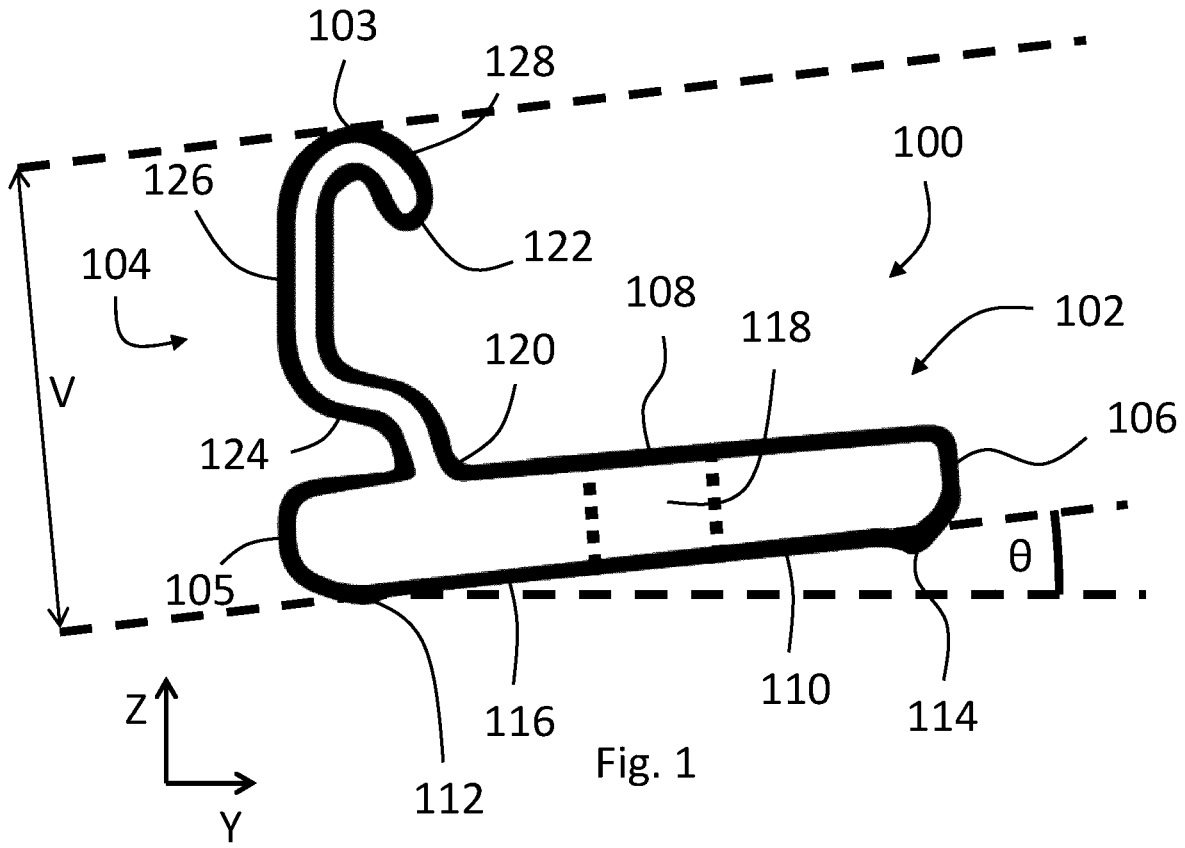
FIG. 1 is an end view of a first decking clip according to the present invention.
Figure 2:
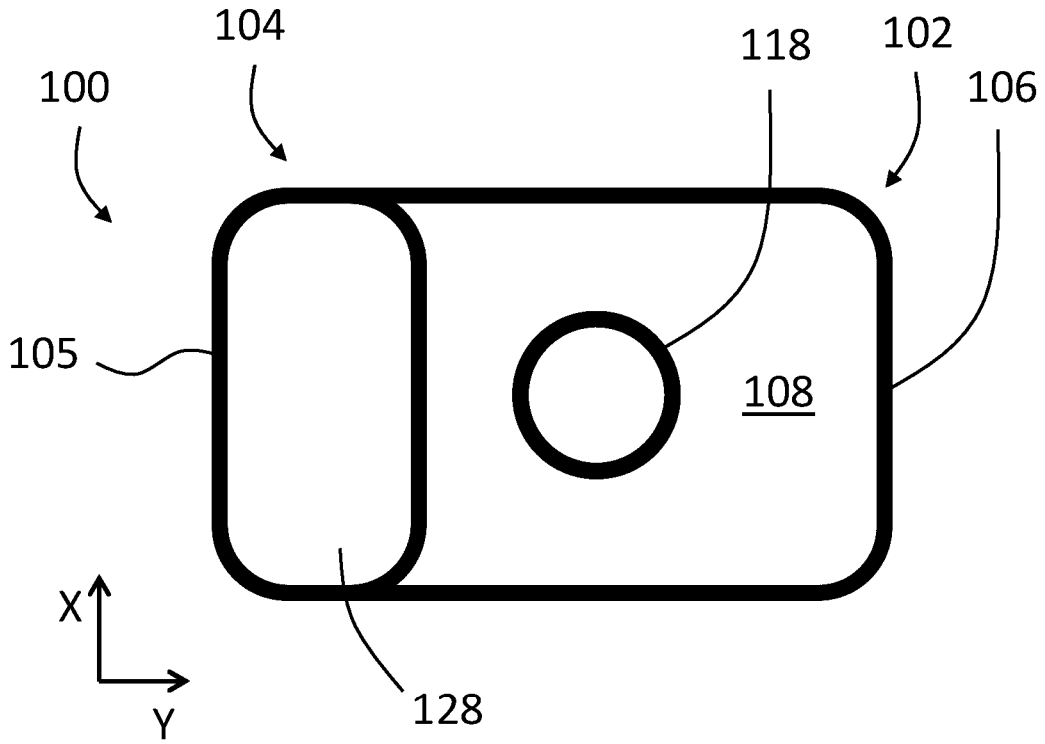
FIG. 2 is a top view of the clip of FIG. 1.

Referring to FIGS. 1 and 2, a decking clip 100 is provided. The clip 100 is a unitary component which in this case is constructed from an extruded aluminium material. The clip 100 is generally prismatic, having a constant cross-sectional profile (except for an opening, which will be described below). For the purposes of this description, the clip 100 has a longitudinal direction X along its prism axis, a transverse, horizontal direction Y and a vertical direction Z.

The profile of the clip 100 comprises a base 102 and an upright 104.

The base 102 is generally flat and planar having a first edge 105 and a second edge 106, a first, upper surface 108 and a second, lower surface 110. The base 102 has two feet 112, 114 each running in the longitudinal direction X. The first foot 112 is proximate the first edge 105, and the second foot 114 proximate the second edge 106. The feet therefore define a raised portion 116 therebetween.

The base 102 defines a fastener opening 118 in the centre thereof, positioned between the feet 112, 114. The opening passes through the thickness of the base 102 and is coincident with the raised portion 116.

The upright 104 defines a profile having a first, lower end 120 attached to the base 102 on the upper surface 108 of the base. The first end 120 is positioned inboard of the first foot 112 such that it is positioned above the raised portion 116. The upright has and a second, free end 122 distal to the base 102. The upright is of generally constant thickness but has a curved profile as will be described below.

The profile of the upright 104, starting from the first end 120 has a first curved portion 124 extending towards the first edge 104. The first curved portion 124 is generally S-shaped such that the profile of the upright 104 moves towards and over the first foot 112 where it joins a straight section 126. The straight section 126 extends in the vertical or X direction to a second curved portion 128 which is semi-circular in form. The second curved portion terminates in the second, free end 122 that faces the base 102 and is positioned vertically above the lower end 120 of the upright 104. As such, the upright 104 defines an elongate 'C' shape facing from proximate the first edge 104 in the direction of the second edge 106—i.e. in the direction of the opening 118.

Referring to FIG. 1, the upright 104 is shown as vertical (aligned with the Z axis). The base 102 on the other hand is angled upwards from the Y axis by θ degrees, such that the upright 104 and base 102 form an angle of less than 90 degrees-specifically 90-θ degrees.

The outer surface of the decking clip is coated in a coating material 103. The coating material (in this case paint) is less stiff than the material from which the clip is constructed. It is elastically deformable, and resiliently compressible.

Figure 3:
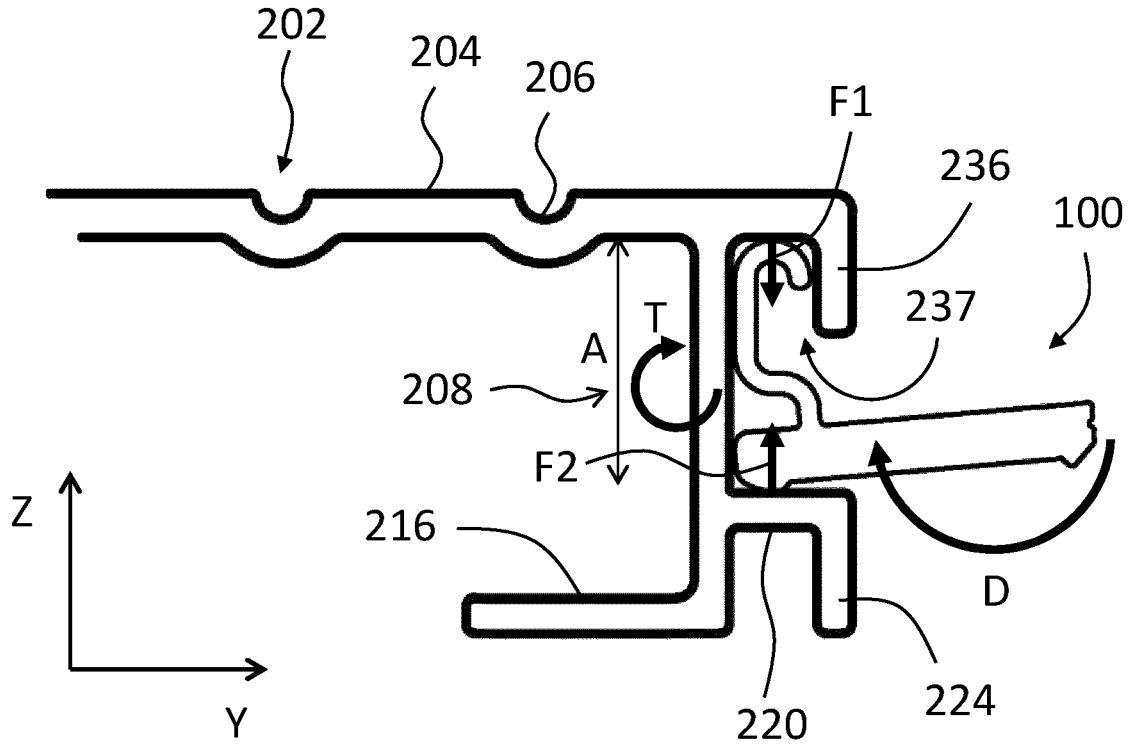
FIG. 3 is a side view of the clip of FIG. 1 in a first step of installation into a decking assembly.

Turning to FIG. 3, the clip 100 is shown in a first stage of installation. An extruded aluminium decking panel 202 is prismatic in shape. The cross-sectional profile of the panel 202 is shown partially in FIG. 3. It will be noted that the decking panel 202 is generally symmetrical having a similar profile on the other side in the Y direction. Each panel has a flat, substantially planar deck 204. The deck 204 has a plurality of longitudinally extending grooves 206 defined therein to enhance grip and drainage.

The panel profile defines a leg 208 extending downwardly from the deck 204. Leg 208 is defined at the edge of the profile. The leg 208 at the free end (opposite the deck 204) defines an inwardly projecting first foot portion 216. The foot portion 216 is a flange extending from the free end of the leg. Extending outwardly from the leg 208 partway up, there is provided a flange 220 forming a shoulder at 90 degrees to the leg, which terminates in a downwardly depending toe portion 224.

At the edge of the deck profile a downwardly depending end flange 236 is provided. The end flange 236 is aligned with (i.e. vertically above) the toe portion 224. The end flange 236 is spaced apart from the leg 208 to define a pocket 237.

The clip 100 is assembled with the panel 202 by hooking the curved portion 128 into the pocket 237. The clip 100 is then rotated in a direction D until the first edge 105 abuts the outer side of the leg 208, and the foot 112 abuts the top surface of the flange 220 forming a shoulder. It will be noted that the height of the clip V (FIG. 1) is similar to the vertical distance A between the upper surface of the flange 220 and the upper inner surface of the pocket 237. The coating of the clip 100, needs to be elastically deformed in order to fit it into the deck profile.

The top of the clip 100 (i.e. the uppermost extend of the upright 104) is positioned horizontally inboard of the first foot 112. This means that the reaction forces F1 (from the pocket, downwardly on the clip) and F2 (from the foot upwardly on the clip) form a torque T in a direction configured to retain the clip 100 in the decking panel. This enables the clip 100 to be held in position as the panel 202 is put into place.

Figure 4:
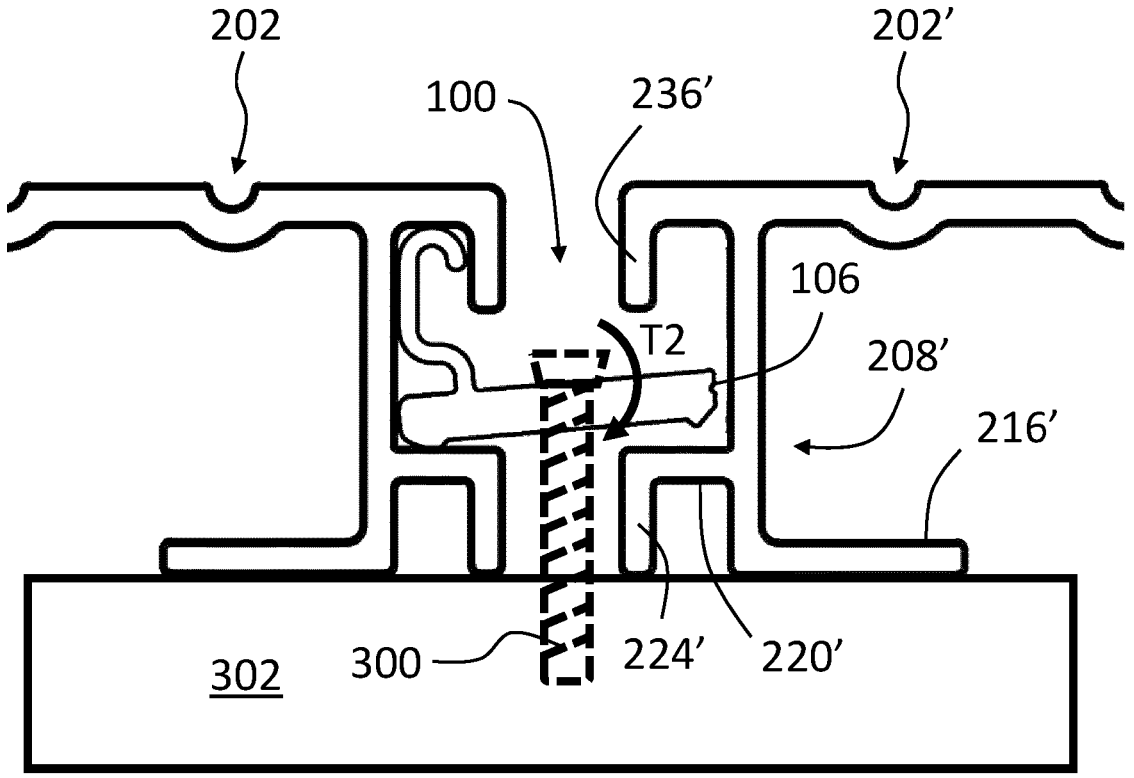
FIG. 4 is a side view of the clip of FIG. 1 in a second step of installation into a decking assembly.

Referring to FIG. 4, the next step of installation is shown in which a further decking panel 202', identical to the first is installed adjacent thereto. Whereas the right-hand side of the panel 202 is shown in FIGS. 3 and 4, the mirror-image left-hand side of the panel 202' is shown in FIG. 4. The panel 202' is moved towards the panel 202 such that the second edge 106 of the clip base 102 sits above the flange 220' of the panel 202', adjacent the leg 208'. It will be noted that because the base 102 is at an angle of 90-θ degrees to the upright, which is held snugly in the pocket 237, the base 102 sits above the flange 220', not in contact therewith. In other words there is a gap between the flange 220' and base 102 (or specifically the foot 114). This is beneficial because it allows the decking panel 202' to be slid into position adjacent the decking panel 202 without the clips hitting the side of the panel 202'.

Once the panel 202' is in position—i.e. once the base 102 abuts the leg 208', a fastener (in this case a screw 300) is passed through the opening 118 of the clip 100 to be engaged with an underlying substrate 302. As the fastener 300 is tightened, the base 102 of the clip 100 is drawn downwards, applying a torque T2, elastically deforming the clip 100 until the foot 114 abuts the flange 220'. The raised portion 116 is also drawn downwards in bending as the fastener 300 is tightened.

It will be noted that the upright 104 is constructed with a lower thickness than the base 102. This coupled with the fact that the upright 104 is curved in profile enables it to act as a spring to permit rotation of the base 102 relative thereto. By tightening the fastener, the clip 100 is "opened out", increasing the angle between the base 102 and upright 104 to 90 degrees.

Once tightened, the fastener 300 is placed in tension due to the elastic deformation of the clip 100. This mitigates loosening and vibration/rattling. Further, both panels 202, 202' are clamped by the clip 100 thus reducing movement and therefore vibration/rattling.

It will be noted that multiple clips 100 are provided per panel 202 to secure it to the substrate 302 and adjacent panel 202'. Further such panels may also be assembled in a similar manner to form a decking assembly.

VARIATIONS

The clip 100 may be constructed from other materials. It may be constructed from other metal materials, such as steel or plastics materials, although it will be noted that plastics may be less desirable in certain applications dues to their reduced fire resistance.

The clip may be manufactured in a number of ways, including extrusion and moulding.

The invention claimed is:

1. A decking assembly comprising:
- a first decking panel;
- a second decking panel adjacent the first decking panel;
- a decking clip comprising a base and a retaining portion, wherein:
- the retaining portion is configured to engage the first decking panel such that the decking clip in retained in engagement with the first decking panel; and,
- when retained in engagement with the first decking panel, the base of the decking clip projects from the first decking panel at a non-zero angle from the first decking panel to the second decking panel to provide a clearance gap between the base of the decking clip and the second decking panel;
- wherein the base of the decking clip defines a fastener opening for receiving a fastener, such that the fastener can be tightened to close the clearance gap to bring the base of the decking clip into contact with the second decking panel and secure the first and second decking panels to an underlying substrate.

2. A decking assembly according to claim 1, wherein an angle of less than 90 degrees is defined between the retaining portion and the base in an undeformed state of the clip.

3. A decking assembly according to claim 1, wherein the retaining portion is an upright extending from the base, and the upright has a lower thickness than the base.

4. A decking assembly according to claim 1, wherein the retaining portion comprises a curved portion, the curved portion configured to engage with a receiving formation of the first decking panel.

5. A decking assembly according to claim 4 wherein the first decking panel comprises a support flange and a pocket above the support flange, and wherein the retaining portion is an upright engaging the pocket when the base contacts the flange.

6. A decking assembly according to claim 5, wherein the upright comprises an S-shaped portion proximate the base to facilitate elastic deformation.

7. A decking assembly according to claim 6, wherein the clip is configured such that the contact between the upright and the pocket and the contact between the flange and the base is such that a torque is applied to the clip to retain the clip relative to the first decking panel.

8. A decking assembly according to claim 1, wherein the base defines a first foot contacting the first decking panel and a second foot contacting the second decking panel.

9. A decking assembly according to claim 1, wherein the retaining portion comprises a U-shaped portion proximate a free end.

10. A decking assembly according to claim 9, wherein the uppermost tip of the upright is curved.

11. A decking assembly according to claim 10, wherein the uppermost tip of the upright engages the first panel.

12. A decking assembly according to claim 1, wherein:
- the first decking panel comprises a first decking panel leg;
- the second decking panel comprises a second decking panel leg; and
- the base of the decking clip abuts the first and second decking panel legs to space the first and second decking panels apart such that the fastener can be tightened.

13. A method of installing a decking assembly comprising the steps of:
- providing a first decking panel;
- providing a second decking panel;
- providing a decking clip comprising a base and a retaining portion, the base having an opening for a fastener;
- affixing the clip to the first decking panel by engaging the retaining portion into the first decking panel to retain the decking clip;
- positioning the second decking panel adjacent the first decking panel such that the base of the decking clip projects from the first decking panel at a non-zero angle from the first decking panel to the second decking panel to provide a clearance gap between the base of the decking clip and the second decking panel;
- securing a fastener through the opening and thereby elastically deforming the base of the decking clip to bring the base of the decking clip into contact with the second decking panel and clamp the first and second decking panels to an underlying substrate.

14. A method of installing a decking assembly according to claim 13, wherein the decking clip is configured to be a tight fit in the decking panel to retain the decking clip.

15. A method of installing a decking assembly according to claim 13, wherein the decking clip comprises a coating of a resilient material, which material is compressed upon engagement with the first decking panel.

16. A method according to claim 13, wherein:
- the first decking panel comprises a first decking panel leg;
- the second decking panel comprises a second decking panel leg; and
- the base of the decking clip abuts the first and second decking panel legs to space the first and second decking panels apart when the fastener is secured.

* * * * *